US006024129A

United States Patent [19]

Schima

[11] Patent Number: 6,024,129

[45] Date of Patent: Feb. 15, 2000

[54] PRODUCTION EFFICIENT VENTURI INSERT

[76] Inventor: Frank E. Schima, 3528 43rd St., Highland, Ind. 46322

[21] Appl. No.: 09/116,970

[22] Filed: Jul. 16, 1998

[51] Int. Cl.[7] ..... F15D 1/02

[52] U.S. Cl. ..... 138/44; 138/40

[58] Field of Search ..... 138/40, 44

[56] References Cited

U.S. PATENT DOCUMENTS

| | | | |
|---|---|---|---|
| 2,118,428 | 5/1938 | Chrisman | 138/40 |
| 2,146,100 | 2/1939 | Walch | 138/44 |
| 2,223,242 | 11/1940 | Sweet, Jr. | 138/44 |
| 2,790,463 | 4/1957 | Delano et al. | 138/44 |
| 3,109,459 | 11/1963 | Lee, II et al. | 138/41 |
| 3,156,225 | 11/1964 | Linn | 138/44 |
| 3,894,562 | 7/1975 | Moseley, Jr. et al. | 138/44 |
| 4,232,711 | 11/1980 | Ray, Sr. et al. | 138/44 |
| 4,426,213 | 1/1984 | Stavropoulus | 138/44 |
| 4,435,199 | 3/1984 | Potkay | 138/44 |
| 5,123,452 | 6/1992 | LeBlanc | 138/44 |
| 5,906,225 | 5/1999 | Stark et al. | 138/44 |

*Primary Examiner*—James F. Hook

[57] ABSTRACT

A new production efficient venturi insert for mixing powder with an air stream to the feed line of a gun outlet of a powder application system. The inventive device includes a generally cylindrical member having an inlet end and a outlet end, a generally cylindrical outer surface, and an inner surface defining a lumen. The outer surface of the member has spaced apart first and second annular grooves therearound positioned towards the outlet end of the member. The inner surface of the member has a first frusto-conical portion, a cylindrical portion, and a second frusto-conical portion. The first frusto-conical portion is positioned adjacent the inlet end of the member and tapers towards the outlet end of the member. The second frusto-conical portion is positioned adjacent the outlet end of the member tapers towards the inlet end of the member. The cylindrical portion is interposed between the first and second frusto-conical portions.

12 Claims, 3 Drawing Sheets

PRODUCTION EFFICIENT VENTURI INSERT

BACKGROUND OF THE INVENTION

1. Field of the Invention

The present invention relates to venturi inserts for powder application systems and more particularly pertains to a new production efficient venturi insert for mixing powder with an air stream to the feed line of a gun outlet of a powder application system.

2. Description of the Prior Art

The use of venturi inserts for powder application systems is known in the prior art. More specifically, venturi inserts for powder application systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art venturi inserts for powder application systems include U.S. Pat. Nos. 4,729,513; 5,037,247; 4,634,058; 5,183,206; 4,896,833; and U.S. Pat. No. Des. 283,832.

While these devices fulfill their respective, particular objectives and requirements, the aforementioned patents do not disclose a new production efficient venturi insert. The inventive device includes a generally cylindrical member having an inlet end and a outlet end, a generally cylindrical outer surface, and an inner surface defining a lumen. The outer surface of the member has spaced apart first and second annular grooves therearound positioned towards the outlet end of the member. The inner surface of the member has a first frusto-conical portion, a cylindrical portion, and a second frusto-conical portion. The first frusto-conical portion is positioned adjacent the inlet end of the member and tapers towards the outlet end of the member. The second frusto-conical portion is positioned adjacent the outlet end of the member tapers towards the inlet end of the member. The cylindrical portion is interposed between the first and second frusto-conical portions.

In these respects, the production efficient venturi insert according to the present invention substantially departs from the conventional concepts and designs of the prior art, and in so doing provides an apparatus primarily developed for the purpose of mixing powder with an air stream to the feed line of a gun outlet of a powder application system.

SUMMARY OF THE INVENTION

In view of the foregoing disadvantages inherent in the known types of venturi inserts for powder application systems now present in the prior art, the present invention provides a new production efficient venturi insert construction wherein the same can be utilized for mixing powder with an air stream to the feed line of a gun outlet of a powder application system.

The general purpose of the present invention, which will be described subsequently in greater detail, is to provide a new production efficient venturi insert apparatus and method which has many of the advantages of the venturi inserts for powder application systems mentioned heretofore and many novel features that result in a new production efficient venturi insert which is not anticipated, rendered obvious, suggested, or even implied by any of the prior art venturi inserts for powder application systems, either alone or in any combination thereof.

To attain this, the present invention generally comprises a generally cylindrical member having an inlet end and a outlet end, a generally cylindrical outer surface, and an inner surface defining a lumen. The outer surface of the member has spaced apart first and second annular grooves therearound positioned towards the outlet end of the member. The inner surface of the member has a first frusto-conical portion, a cylindrical portion, and a second frusto-conical portion. The first frusto-conical portion is positioned adjacent the inlet end of the member and tapers towards the outlet end of the member. The second frusto-conical portion is positioned adjacent the outlet end of the member tapers towards the inlet end of the member. The cylindrical portion is interposed between the first and second frusto-conical portions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new production efficient venturi insert apparatus and method which has many of the advantages of the venturi inserts for powder application systems mentioned heretofore and many novel features that result in a new production efficient venturi insert which is not anticipated, rendered obvious, suggested, or even implied by any of the prior art venturi inserts for powder application systems, either alone or in any combination thereof.

It is another object of the present invention to provide a new production efficient venturi insert which may be easily and efficiently manufactured and marketed.

It is a further object of the present invention to provide a new production efficient venturi insert which is of a durable and reliable construction.

An even further object of the present invention is to provide a new production efficient venturi insert which is susceptible of a low cost of manufacture with regard to both materials and labor, and which accordingly is then susceptible of low prices of sale to the consuming public, thereby making such production efficient venturi insert economically available to the buying public.

Still yet another object of the present invention is to provide a new production efficient venturi insert which provides in the apparatuses and methods of the prior art some of the advantages thereof, while simultaneously overcoming some of the disadvantages normally associated therewith.

Still another object of the present invention is to provide a new production efficient venturi insert for mixing powder with an air stream to the feed line of a gun outlet of a powder application system.

Yet another object of the present invention is to provide a new production efficient venturi insert which includes a generally cylindrical member having an inlet end and a outlet end, a generally cylindrical outer surface, and an inner surface defining a lumen. The outer surface of the member has spaced apart first and second annular grooves therearound positioned towards the outlet end of the member. The inner surface of the member has a first frusto-conical portion, a cylindrical portion, and a second frusto-conical portion. The first frusto-conical portion is positioned adjacent the inlet end of the member and tapers towards the outlet end of the member. The second frusto-conical portion is positioned adjacent the outlet end of the member tapers towards the inlet end of the member. The cylindrical portion is interposed between the first and second frusto-conical portions.

Still yet another object of the present invention is to provide a new production efficient venturi insert that is designed to last longer and be more efficient at mix powder with air that prior art venturi inserts.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
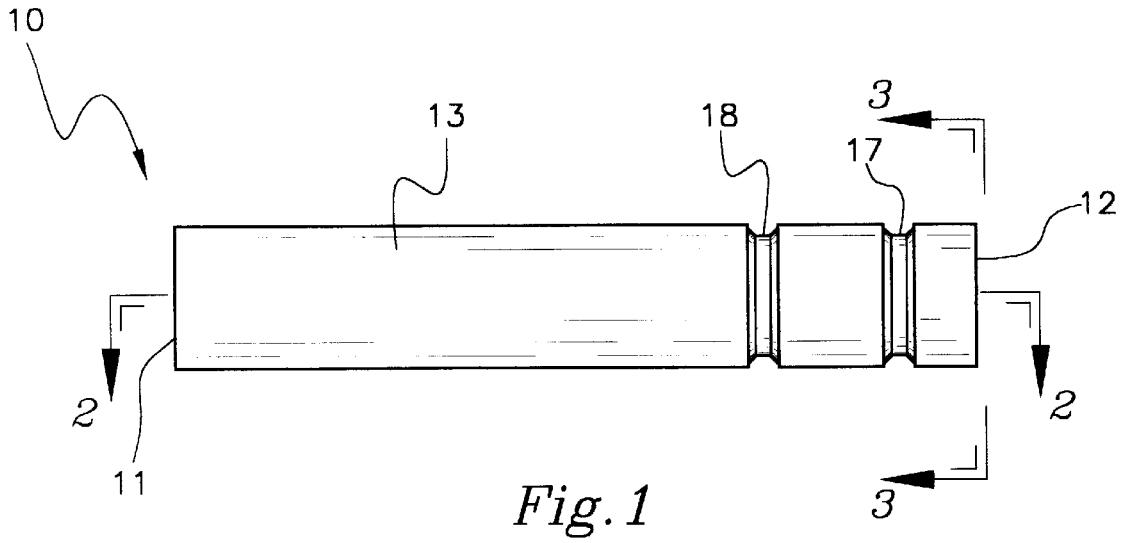
FIG. 1 is a schematic side view of a new production efficient venturi insert according to the present invention.
Figure 2:
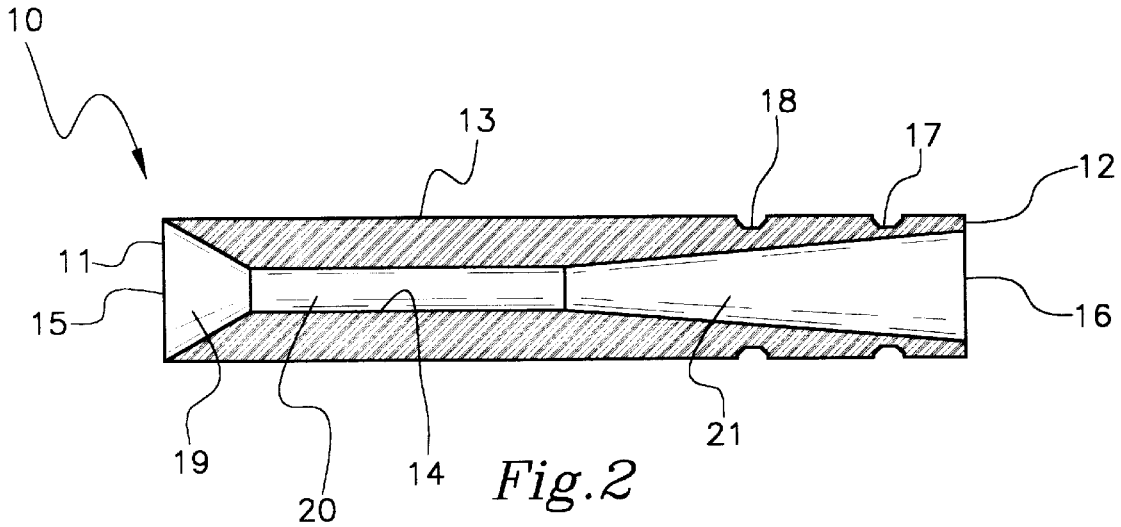
FIG. 2 is a schematic cross sectional view of the present invention taken from line 2—2 of FIG. 2.

With reference now to the drawings, and in particular to FIGS. 1 through 6 thereof, a new production efficient venturi insert embodying the principles and concepts of the present invention and generally designated by the reference numeral 10 will be described.

As best illustrated in FIGS. 1 through 6, the production efficient venturi insert 10 generally comprises a generally cylindrical member 10 having an inlet end 11, an outlet end 12, a generally cylindrical outer surface 13, and an inner surface 14 defining a lumen. The outer surface 13 of the member 10 has spaced apart first and second annular grooves 17,18 therearound positioned towards the outlet end 12 of the member 10. The inner surface 14 of the member 10 has a first frusto-conical portion 19, a cylindrical portion 20, and a second frusto-conical portion 21. The first frusto-conical portion 19 is positioned adjacent the inlet end 11 of the member 10 and tapers towards the outlet end 12 of the member 10. The second frusto-conical portion 21 is positioned adjacent the outlet end 12 of the member 10 tapers towards the inlet end 11 of the member 10. The cylindrical portion 20 is interposed between the first and second frusto-conical portions 19,21.

Figure 5:
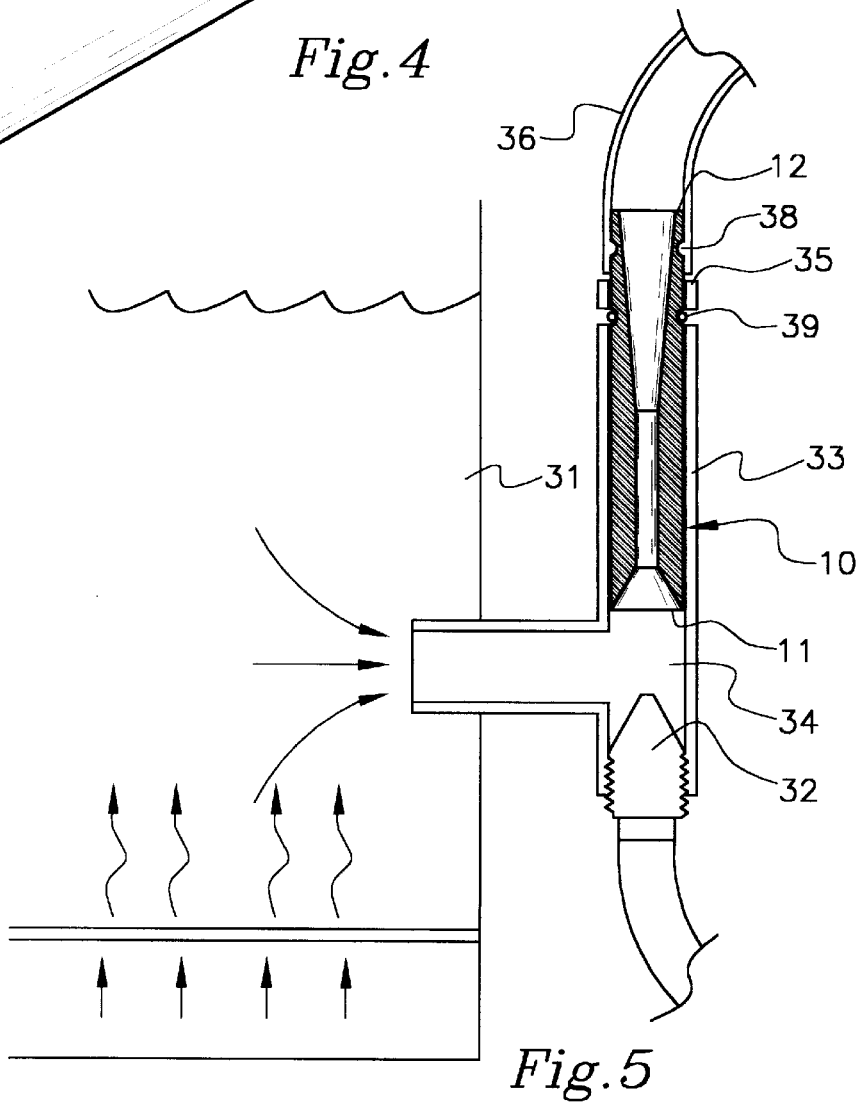
FIG. 5 is a schematic view of the present invention in use in a pump/venturi housing.
Figure 6:
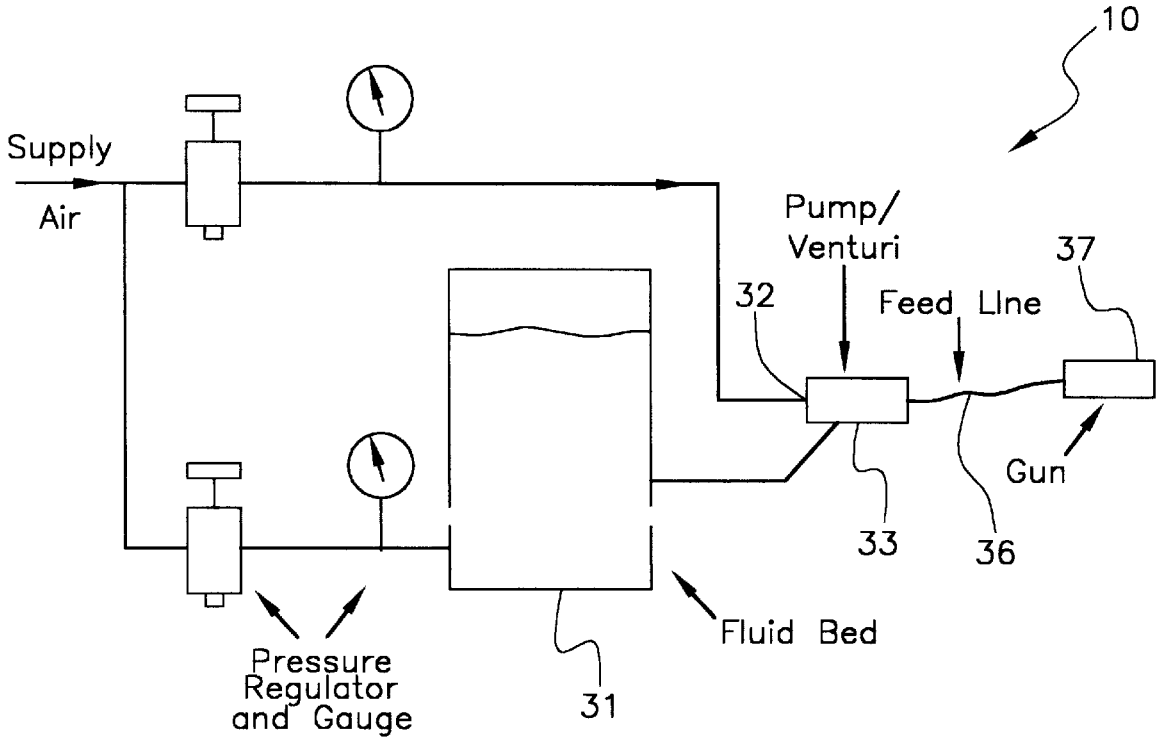
FIG. 6 is a schematic view of a powder application system.

In use, the venturi insert 10 is designed for installation in a pump/venturi housing 33 of a powder application system 30. As illustrated in FIGS. 5 and 6, the powder application system 31 has a fluid bed 31 and an air supply nozzle 32 fluidly connected to an input end 34 of the pump/venturi housing 33 and a feed line 36 to an gun output 37 fluidly connected to an output end 35 of the pump/venturi housing 33. An example of the powder application system 30 is a system for spaying a fusion bond epoxy coating onto an object such as a pipe or rebar. In use, the fluid bed 31 is designed for suspending powder particles in an air stream so that the powder tends to flows more like a fluid and is easily transported. The pump/venturi housing 33 is designed for picking up powder from the fluid bed 31 and mixing it with an air stream from the air supply nozzle 32 to transport the powder and air mixture to the feed line 36. With reference to FIG. 5, air leaving the air supply nozzle 32 is directed into the flared opening of the venturi insert. Due to the velocity change, the pressure in the area around the air supply nozzle 32 is reduced. As a result of this reduced air pressure, the air/powder mixture from the fluid bed 31 is drawn into the pump/venturi housing 33. Since the powder is abrasive, the venturi insert wears rapidly and the pressure drop around the air supply nozzle 32 is affected. This reduces the quality of material drawn from the fluid bed 31 and can result in gun surging and loss of thickness control.

In closer detail, the venturing insert 10 comprises a generally cylindrical member having an inlet end 11, a outlet end 12, a generally cylindrical outer surface 13 and an inner surface 14 defining a lumen. The inlet end 11 of the member 10 has a generally circular opening 15 into the lumen of the member 10 and the outlet end 12 of the member 10 also has a generally circular opening 16 into the lumen of the member 10. The member 10 has an axis extending through the inlet and outlet ends 11,12 of the member 10 with the openings 15,16 of the inlet and outlet ends 11,12 of the member 10 being coaxial with the axis of the member 10. The member 10 preferably has a length defined between the inlet and outlet ends 11,12 of the member 10 of about 3.125 inches and preferably no greater than about 3½ inches. The member 10 preferably has a diameter of about 0.56 inches. The openings 15,16 of the inlet and outlet ends 11,12 of the member 10 each have a radius. The radius of the opening 15 of the inlet end 11 is greater than the opening 16 of the outlet end 12 of the member 10. Ideally, the radius of the opening 15 of the inlet end 11 is about 0.245 inches and the opening 16 of the outlet end 12 of the member 10 is about 0.2175.

Ideally, the member 10 comprises a material comprising about seventy-five percent polytetrafluoroethylene (Teflon) and about twenty-five percent glass.

The outer surface 13 of the member 10 has spaced apart first and second annular grooves 17,18 therearound. The annular grooves 17,18 are positioned towards the outlet end 12 of the member 10. Preferably, the inner corners of the annular grooves 17,18 each having a 45 degree bevel. Ideally, the annular grooves 17,18 each have a width defined between the ends of the member 10 of about 0.12 inches. Ideally, the first annular groove 17 is spaced apart from the outlet end 12 of the member 10 greater than about 0.24 inches and the second annular groove 18 is spaced apart from the outlet end 12 of the member 10 less than about 0.89 inches. As illustrated in FIG. 5, the first annular groove 17 is designed for receiving an annular ridge 38 on the feed line 36 to hold the outlet end 12 of the member 10 to the feed line 36. The second annular groove 18 is designed for receiving a holding clip 39 for holding the member 10 to the pump/venturi housing 33.

Figure 3:
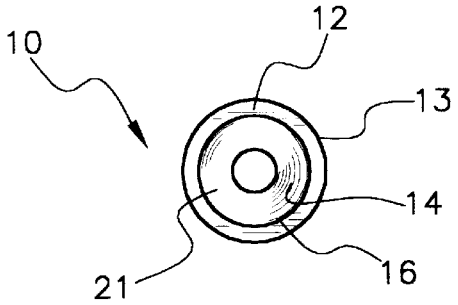
FIG. 3 is a schematic side view of the outlet end of the present invention as seen from line 3—3 of FIG. 1.
Figure 4:
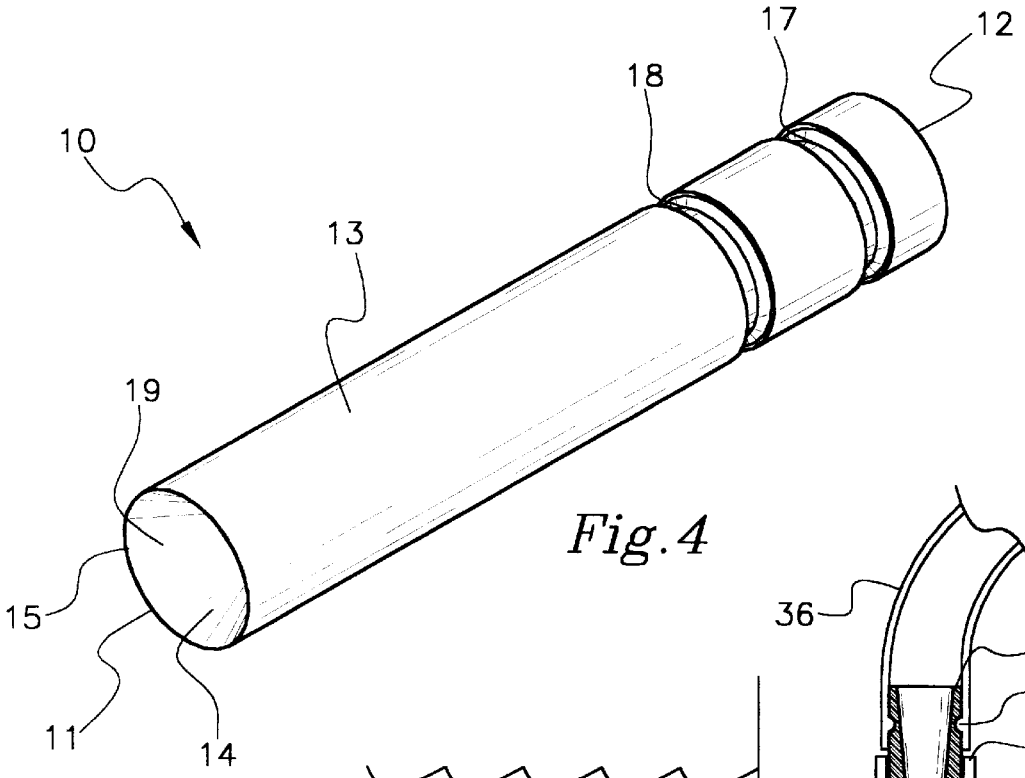
FIG. 4 is a schematic perspective view of the inlet end of the present invention.

With reference to FIG. 3, the inner surface 14 of the member 10 has a first frusto-conical portion 19, a cylindrical portion 20, and a second frusto-conical portion all coaxial with the axis of the member 10. The first frusto-conical portion 19 is positioned adjacent the inlet end 11 of the member 10 and tapers towards the outlet end 12 of the member 10. The inner surface 14 in the first frusto-conical portion 19 is orientated at a first acute angle with respect to the axis of the member 10. The first frusto-conical portion 19 also has a length defined between the inlet and outlet ends 11,12 of the member 10. The second frusto-conical portion 21 is positioned adjacent the outlet end 12 of the member 10 and tapers towards the inlet end 11 of the member 10. The inner surface 14 in the second frusto-conical portion 21 is orientated at a second acute angle with respect to the axis of the member 10 and the second frusto-conical portion 21 also has a length defined between the inlet and outlet ends 11,12 of the member 10. Preferably, the first acute angle of the first frusto-conical portion 19 is greater than the second acute angle of the second frusto-conical portion 21. Ideally, the first acute angle of the first frusto-conical portion 19 is about 30 degrees and the second acute angle of the second frusto-conical portion 21 is about 6 degrees.

The cylindrical portion 20 is interposed between the first and second frusto-conical portions 19,21. The cylindrical portion 20 has a length defined between the inlet and outlet ends 11,12 of the member 10. Ideally, the cylindrical portion 20 has a diameter of about 0.171 inch. Ideally, the length of the second frusto-conical portion 21 is greater than the length of the first frusto-conical portion 19 and also greater than the length of the cylindrical portion 20. Ideally, the length of the second frusto-conical portion 21 is about 1.56 inches. Preferably, the length of the cylindrical portion 20 is greater than the length of the first frusto-conical portion 19.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A venturi insert for installation in a pump/venturi housing of a powder application system, said venturing insert comprising:

a generally cylindrical member having an inlet end and a outlet end, a generally cylindrical outer surface, and an inner surface defining a lumen, said inlet end of said member having a generally circular opening into said lumen of said member, said outlet end of said member having a generally circular opening into said lumen of said member, said outer surface of said member having a substantially uniform diameter along substantially an entire length of said member for facilitating sliding removal from and sliding insertion into an outlet end of a pump/venturi housing;

said member having an axis extending through said inlet and outlet ends of said member, said openings of said inlet and outlet ends of said member being coaxial with said axis of said member;

said outer surface of said member having spaced apart first and second annular grooves therearound, said annular grooves being positioned towards said outlet end of said member;

said inner surface of said member having a first frusto-conical portion, a cylindrical portion, and a second frusto-conical portion;

said first frusto-conical portion being positioned adjacent said inlet end of said member, said first frusto-conical portion tapering towards said outlet end of said member, said first frusto-conical portion being coaxial with said axis of said member, the inner surface in said first frusto-conical portion being orientated at a first acute angle with respect to said axis of said member;

said second frusto-conical portion being positioned adjacent said outlet end of said member, said second frusto-conical portion tapering towards said inlet end of said member, said second frusto-conical portion being coaxial with said axis of said member, the inner surface in said second frusto-conical portion being orientated at a second acute angle with respect to said axis of said member;

said cylindrical portion being interposed between said first and second frusto-conical portions, said cylindrical portion being coaxial with said axis of said member;

wherein said first acute angle of said first frusto-conical portion is greater than said second acute angle of said second frusto-conical portion.

2. The venturi insert of claim 1, wherein said length of said member is defined between said inlet and outlet ends of said member of about 3.125 inches, and wherein said diameter of said member is about 0.56 inches.

3. The venturi insert of claim 1, wherein said opening of said inlet end of said member having a radius, said opening of said outlet end of said member having a radius, wherein said radius of said opening of said inlet end is greater than said opening of said outlet end of said member.

4. The venturi insert of claim 3, wherein said radius of said opening of said inlet end is about 0.245 inches and said opening of said outlet end of said member is about 0.2175.

5. The venturi insert of claim 1, wherein said member comprises a material comprises about seventy-five percent polytetrafluoroethylene and about twenty-five percent glass.

6. The venturi insert of claim 1, wherein said cylindrical portion has a diameter of about 0.171 inch.

7. The venturi insert of claim 1, wherein said first acute angle of said first frusto-conical portion is about 30 degrees, wherein said second acute angle of said second frusto-conical portion is about 6 degrees.

8. The venturi insert of claim 1, wherein said length of said second frusto-conical portion is greater than said length of said first frusto-conical portion and wherein said length of said second frusto-conical portion is greater than said length of said cylindrical portion.

9. The venturi insert of claim 8, wherein said length of said second frusto-conical portion is about 1.56 inches.

10. The venturi insert of claim 9, wherein said length of said cylindrical portion is greater than said length of said first frusto-conical portion.

11. The venturi insert of claim 1, wherein each of said annular grooves having a depth substantially equal to the depth of the other of said annular grooves.

12. A powder application system, comprising:

a pump/venturi housing having an inlet end and an outlet end;

a venturi insert for installation in said outlet end of said pump/venturi housing;

fluid bed;

an air supply nozzle fluidly connected to said inlet end of said pump/venturi housing;

a feed line to a gun output fluidly connected to said outlet end of said pump/venturi housing;

said venturing insert comprising:

a generally cylindrical member having an inlet end and a outlet end, a generally cylindrical outer surface and an inner surface defining a lumen, said inlet end of said member having a generally circular opening into said lumen of said member, said outlet end of said member having a generally circular opening into said lumen of said member, said outer surface of said member having a substantially uniform diameter along substantially an entire length of said member for facilitating sliding removal from and sliding insertion into the outlet end of said pump/venturi housing;

said length of said member being defined between said inlet and outlet ends of said member of about 3.125 inches, said diameter of said member of about 0.56 inches;

said opening of said inlet end of said member having a radius, said opening of said outlet end of said member having a radius, wherein said radius of said opening of said inlet end is greater than said opening of said outlet end of said member, wherein said radius of said opening of said inlet end is about 0.245 inches and said opening of said outlet end of said member is about 0.2175 wherein said member comprises a material comprising about seventy-five percent polytetrafluoroethylene and about twenty-five percent glass;

said member having an axis extending through said inlet and outlet ends of said member, said openings of said inlet and outlet ends of said member being coaxial with said axis of said member;

said outer surface of said member having spaced apart first and second annular grooves therearound, said annular grooves being positioned towards said outlet end of said member, each of said annular substantially equal to the depth of the other of said annular grooves;

said inner surface of said member having a first frusto-conical portion, a cylindrical portion, and a second frusto-conical portion;

said first frusto-conical portion being positioned adjacent said inlet end of said member, said first frusto-conical portion tapering towards said outlet end of said member, said first frusto-conical portion being coaxial with said axis of said member, the inner surface in said first frusto-conical portion being orientated at a first acute angle with respect to said axis of said member, said first frusto-conical portion having a length defined between said inlet and outlet ends of said member;

said second frusto-conical portion being positioned adjacent said outlet end of said member, said second frusto-conical portion tapering towards said inlet end of said member, said second frusto-conical portion being coaxial with said axis of said member, the inner surface in said second frusto-conical portion being orientated at a second acute angle with respect to said axis of said member, said second frusto-conical portion having a length defined between said inlet and outlet ends of said member;

said cylindrical portion being interposed between said first and second frusto-conical portions, said cylindrical portion being coaxial with said axis of said member, said cylindrical portion having a length defined between said inlet and outlet ends of said member;

wherein said cylindrical portion has a diameter of about 0.171 inch;

wherein said first acute angle of said first frusto-conical portion is greater than said second acute angle of said second frusto-conical portion, wherein said first acute angle of said first frusto-conical portion is about 30 degrees, wherein said second acute angle of said second frusto-conical portion is about 6 degrees;

wherein said length of said second frusto-conical portion is greater than said length of said first frusto-conical portion and wherein said length of said second frusto-conical portion is greater than said length of said cylindrical portion, wherein said length of said second frusto-conical portion is about 1.56 inches; and wherein said length of said cylindrical portion is greater than said length of said first frusto-conical portion.

* * * * *